US005304066A

United States Patent [19]

Sontag

[11] Patent Number: 5,304,066

[45] Date of Patent: Apr. 19, 1994

[54] MACHINE SHOP MANAGEMENT SYSTEM

[76] Inventor: Walter A. Sontag, Box 70, R.R. #2, Dugald, Manitoba, Canada, R0E 0K0

[21] Appl. No.: 959,724

[22] Filed: Oct. 13, 1992

[51] Int. Cl.[5] ..... G09F 3/00

[52] U.S. Cl. ..... 434/219; 434/222; 434/223; 434/224; 434/108; 434/369; 40/299

[58] Field of Search ..... 434/219, 222, 223, 224, 434/108, 369; 40/299, 360, 625; 283/36, 37, 39, 41, 81; 340/700, 701-703

[56] References Cited

U.S. PATENT DOCUMENTS

| | | | |
|---|---|---|---|
| 1,798,647 | 3/1931 | Anthony | 434/369 |
| 3,937,493 | 2/1976 | Fasbender . | |
| 4,204,639 | 5/1980 | Barber et al. | 40/359 X |
| 4,329,191 | 5/1982 | Barber | 40/359 X |
| 4,523,776 | 6/1985 | Barber . | |
| 4,853,878 | 8/1989 | Brown . | |
| 4,856,820 | 8/1989 | Kasprzak et al. | 283/81 |
| 4,973,086 | 11/1990 | Donnelly et al. . | |

*Primary Examiner*—Richard J. Apley
*Assistant Examiner*—Glenn E. Richman
*Attorney, Agent, or Firm*—Adrian D. Battison; Stanley G. Ade; Murray E. Thrift

[57] ABSTRACT

A method for managing work progress of separate work jobs in a machine shop having a plurality of separate machining operations comprises applying to a work order document a row of colored labels with each colored associated with a respective one of the machining operations. The operator of an operation can therefore readily select jobs that require that operation by simple visual observation. Once that operation is effected, the label is removed and available for the next operation which is readily apparent due to the colored label. The selection of the colors associated with the various operations is effected so that ready recollection is available due to associated by alliteration.

12 Claims, 1 Drawing Sheet

MACHINE SHOP MANAGEMENT SYSTEM

Figure 1:
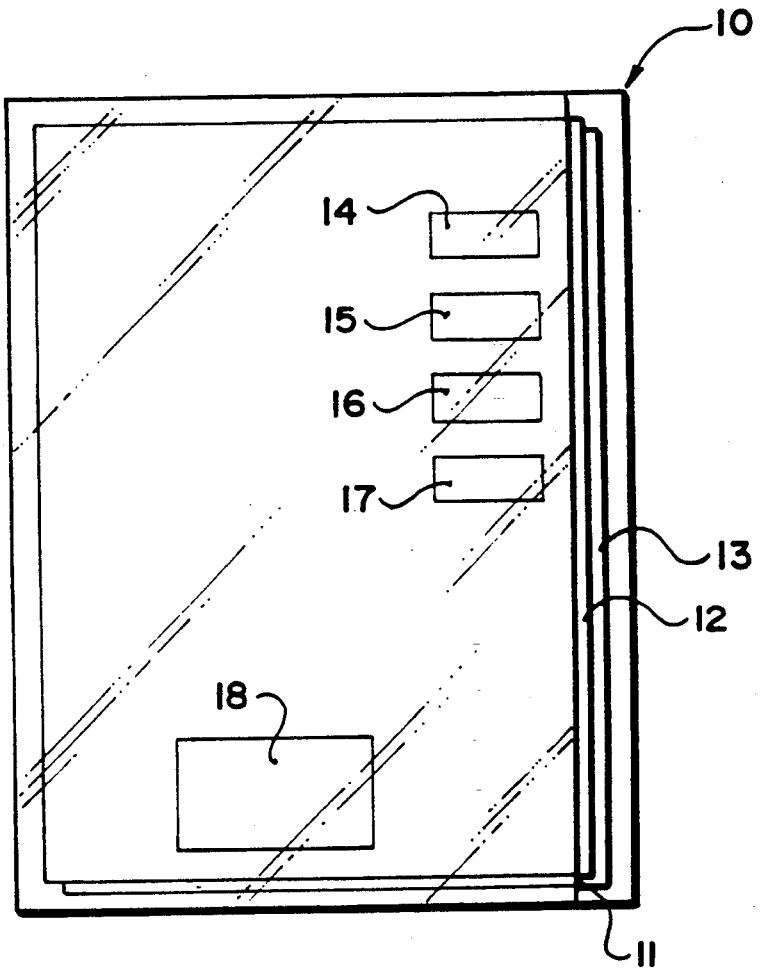

This invention relates to a method of managing work progress of separate work jobs in a machine shop of the type having a plurality of separate machining functions.

Machine shops of this type are used for manufacturing various different parts. It is necessary therefore to control the flow of the material through the machine shop so that each part to be manufactured in moved from function to function until it is completed and can be released from the machine shop.

Much of this control function has been improved by the provision of computer control systems in which the production run for each job is set forth on a computer print out thus forming an order document which includes a computer printout setting out the functions required together with an engineering drawing of the part required. This order document is attached to and transported with the materials forming the separate job.

However the separate functions in the machine shop are generally controlled and operated by persons who must be made aware of the requirement for the particular function on the separate job and then must consider the machine to effect the function on that particular job.

On very large production runs it is possible to automate the whole process so that there is little inefficiency generated by the movement of the materials from function to function. On smaller production runs, however, it is not possible to set up the whole machine shop to effect the processes in a particular order and there are many separate jobs running through the machine shop at any one time. In this situation unfortunately much inefficiency is caused by the difficulty of the machine operators in identifying the separate jobs to be effected on the machine with which they are particularly associated.

The present invention is therefore related particularly to the manufacturing industry with regard to production runs in sheet metal and the like controlled on computer printouts which form an order document accompanying the original materials entering the machine shop. Even in recent years, metal cost and machinery costs were the prime considerations and the use of labour was very much subsidiary to these costs. However, labour costs are significantly increased so that today the efficient management of the labour is of paramount importance.

Any inefficiencies in the use of the labour therefore are particularly expensive and lead to significant increases in final production costs. Unfortunately much time is spent in studying the computer print outs to identify those which are associated with the particular machine or function concerned. The average operator therefore spends much time in looking for the next job to be effected rather than in actually effecting the necessary functions.

The average machine shop manufacturing sheet metal parts have used shears, saws, breaks, punches, rollers, lathes etc. for many years and these machines have remained effectively unaltered for much of that time despite the introduction of some automation in relation to punch presses, breaks, N.C. machines and the like. Improvements have been made to the individual machine functions and new machines such as plasma torch cutting have been added. In most cases, however, the material handling remains an operator function.

It is one object of the present invention to provide an improved method of managing work progress in a machine shop of this type.

According to a first aspect of the invention, therefore, there is provided a method of managing work progress of separate work jobs in a machine shop having a plurality of separate machining functions, the method comprising providing a plurality of colored labels, each separate machining function having associated therewith a specific individual colour of the labels visually distinct from the colours of the labels of the other separate machining functions, forming for each separate job an order document having written instructions thereon for the separate machining functions required for that separate job, applying to the separate job a plurality of said plurality of coloured labels so as to be carried thereby and to be visually apparent thereon, labels applied to the separate job being selected from said plurality of coloured labels such that the labels are applied to the separate job in an order corresponding to the separate machining functions required for that separate job, selecting for each separate machining function a separate job from the plurality of jobs to be effected by visual inspection of the coloured labels, effecting each required machining function in turn to the separate job and, after completion of each machining function, removing the coloured label associated with that machining function from the order of the labels.

According to a second aspect of the invention there is provided a method of managing work progress of separate work jobs in a machine shop having a plurality of separate machining functions, the method comprising providing a plurality of coloured identifying elements associating each separate machining function therewith a specific individual colour of the elements visually distinct from the colours of the elements of the other separate machining functions, forming for each separate job an order document having written instructions thereon for the separate machining functions required for that separate job, applying to the separate job at least one of said coloured elements so as to be carried thereby and to be visually apparent thereon, said at least one element applied to the separate job being selected from said plurality of colours such that said at least one element is applied to the separate job corresponding to the separate machining function required for that separate job, selecting for each separate machining function a separate job from the plurality of jobs to be effected by visual inspection of the coloured element, effecting the required machining function to the separate job and, after completion of the machining function, removing from the job the coloured element associated with that machining function.

In the prior art, colour coding has been used in various fields to identify various items. However, it is believed that up until now the use of colour coding has not been used for the management of material flow in a machine shop and this concept is believed to be unique.

Examples of prior use of colour coding are shown in U.S. Pat. Nos. 4,523,776 (Barber), 3,937,453 (Fasbender) and 4,973,086 (Donnelly). These patents disclosed file folders and the like to which are attached coloured labels which define a numerical labeling system for location of the files in file racks. There is however no disclosure of any management system by which the flow of materials or work is in any way assisted.

U.S. Pat. No. 4,853,878 (Brown) discloses a system for inputting information into a computer in which the colour of the material input provides an instruction to the computer system. However again this provides no system for assisting in the control of work flow through a machine shop.

The prior art therefore in relation to colour coding which has been identified in a search carried out showed nothing of relevance to the present system.

FIG. 1 shows a front elevational view of a work order for use in the present invention.

The work order comprises a document including a transparent outer folder 10 with one side 11 which is open to allow the insertion of paper documents 12 and 13. The transparent folder is formed of a flexible plastics material with an edge seam so as to hold the documents securely and to prevent marking or soiling. The documents 12 and 13 include a computer print out sheet listing the functions to be carried out in the machine shop together with a drawing 13 which shows the dimensions and configuration of the finished part. The drawing includes tolerances and further details.

On the front surface of the transparent folder is provided a plurality of colored stickers 14, 15, 16, 17 and 18. The stickers 14 through 17 are arranged in an aligned row along one side. The sticker 18 is of a larger dimension and is positioned at the bottom of the front face.

In the method of the present invention, therefore, all of the functions of the machine shop are assigned a specific colour. Coloured labels are then generated with the necessary separate colours for each separate machining function.

After the computer generated order is created for the separate machining functions, the coloured labels are selected in accordance with the required functions and are applied in a row to the order document. The order document therefore carries the identification of the separate functions to be effected in a manner which is readily visually apparent.

The operators then can simply visually scan the separate jobs and the associated work order to locate immediately those that are associated with the function in which the operator is concerned. A simple visual scan can be effected very quickly and the next job order selected and brought into operation very quickly without necessity for reading or studying of computer print outs.

In one example a system for manufacturing a relatively large number of parts includes the generation by the computer print out of a work order for each of the jobs. Each work order includes separate sheets having three operations listed on each sheet. Thus if there are only three operations required on a particular job then only a single sheet will be required. A second sheet is required if there are four to six operations; a third is required if there are seven to nine operations, etc. The work order sheets are inserted into a folder of plastic cover which maintains the sheets in good order and against damage.

As part of the work order generation system, the work orders are quickly scanned by a supervisor and labels applied in the order of the operation, each label being associated with a respective one of the operations and labels being applied in the required order. This labeling system can be effected by a computer operated system or can be effected manually for example by a machine shop supervisor who may also at the same time be able to check the accuracy of the order document.

After the operator has visually selected the separate job to be effected next, the work order is studied for the specific operations required and the job is completed in the normal manner. When the job is completed, the label associated with the respective machining operation is removed or otherwise obliterated so that it is no longer visible on the work order. The next visible coloured label therefore identifies the next required operation. The material handler then acts to move the work to the next function or machine station by identifying the next label. When no labels are remaining, the operations are of course necessarily complete.

The selection of colours in association with the respective operations is set out in one example hereinafter. Most preferably the selection of the colours is associated with the operations so that the name of the colour is associated with the name of the operation by alliteration to enable ready recollection of the required association.

In the following example, a total of twenty-two colours is used with the following twelve colours being the easiest for recollection in view of the high level of alliteration and the single syllable of a name of the colour being associated with a single syllable name of an operation.

| | |
|---|---|
| brown - | break |
| red - | roll |
| rose - | route |
| lime - | lathe |
| tan - | tap |
| taupe - | thread |
| blue - | bend |
| peach - | punch |
| grey - | grind |
| pink - | paint |
| black - | bead |
| mauve - | mill |

In a second type, the next three selected colours are both two or three syllable words so that the number of syllables and the alliteration are common to the name of the colour and to the name of the operation.

| | |
|---|---|
| purple - | plasma |
| navy - | N.C. |
| caramel | countersink |

A third type of association involves a two syllable colour name with a single syllable operation with again using the alliteration.

| | |
|---|---|
| silver - | shear |

The last seven colours do not involve any alliteration since no more alliteration combinations are possible. However the choices are made so as to provide again a simple association which enables ready recollection

| | |
|---|---|
| copper - | cut copper tube |
| woodgrain - | woodshop |
| orange - | drill |
| yellow - | laser |
| green - | saw |
| white - | for writing special notations |

The last of these elements provides a label which is again visually readily distinct but in this case the label is used for the application of annotations or information which are of a special nature.

The colored copper sticker is the same colour as the copper tubing providing of course an immediate association. The wood grain again has the immediate association of the common first word. The colour orange is associated with the drill solely by the existence of the single syllable that is provided as a suitable basic color. The term yellow in relation to the laser process uses a word which has two syllables with the letter "L" significant in both. The colour green in relation to the saw process simply uses single syllable association and again uses a suitable remaining basic colour.

In addition to the aligned stickers associated with the separate machining functions, the sticker 18 constitute a coloured sticker identifying a final destination. After the machine stop parts are completed, a final destination is generally indicated so they can be delivered to the required location. In one example as many 25 different locations can be identified by station numbers. The final destination sticker can be used to identify these different stations or in some cases simply to identify a particular job order. In this way if parts are missing for a particular job order, they can be readily found within the machine shop due to the presence of the additional destination sticker 18. Thus the final destination stickers comprise a separate larger sticker placed at the bottom of the transparent plastic jacket. This can simply be a larger sticker with a final destination number written on the sticker. When all operations are complete and thus all of the stickers have been peeled away, the material handler without getting off the lifting equipment can move the completed parts to where they are required.

In relation to the colours that are similar for example caramel, tan and taupe which might otherwise cause confusion, these are associated with functions that very rarely are applied to the same piece of material. It is generally clear therefore that by looking at the material and the work order which both can be visually inspected from a distance which function is required to avoid any confusion. Similarly the blue and navy colours which are used for the bending and NC functions generally would not be applied to the same materials since the bending relates in most cases to hollow tubing and the NC machine generally operates only on flat sheet.

Similarly in relation to the following colours red-rose, lime-green, mauve-purple, black-brown, some confusion may arise simply by observation of the colour but generally this can be overcome simply by observing the colour in relation to the material. Very quickly therefore the operators will become aware of the different shades of colours involved and in addition, if in doubt, can simply look at the material involved with the order which will resolve any confusion.

In an alternative implementation of the method, the same colours can be associated with the separate machinery functions. However, instead of the colours being applied as labels or stickers at the commencement of the operation on the job under document, they can also be applied simply in the form of a loose sheet of coloured film or other loosely placeable element which is placed on or in the container for the job parts. In this implementation, the machinist after completing one machining function applies the coloured element to the container associated with the next machinery function.

The method of the present invention has the following advantages:

1. The information is immediately available to the operator by the single column or row of coloured stickers placed in order of occurrence. Thus the whole story is told in the row of stickers without the necessity for closer inspection. The operator therefore does not have to pull the print out providing the details of the operations from its plastic jacket to look at the print out and particularly to look at the second or third, etc. page of the print out as this is obscured by the first page.

2. A material handler driving a fork lift truck should not have to get off the fork lift to read the work order. The operator can therefore immediately see from a distance by the visually distinct coloured labels exactly where the work order and the associated job should be moved to. It is expected that a fork lift operator should therefore have an increase efficiency leading to the movement of thirty to fifty percent more materials. The materials can also be moved more quickly so that the machine operator is not required to wait or to search for a next job.

3. The tracing or finding of a specific separate job on the machine shop floor can be readily carried out by simple visual inspection of the work orders from a distance since the searcher knows the order of the operations and is sufficiently familiar with the coloured labels to identify that order.

4. There is reduced strain on the operators due to the avoidance of bending to read the detail on the work orders since a simply visual inspection while remaining standing will enable the operator to determine whether the work order is required for that operation. In addition to the strain from bending, eye strain can also be avoided due to the necessity for trying to read the papers from a distance or from constantly changing the position of focus from the working position to a remote position for reading the various part orders. In addition the ability of the person to see the required operation from a distance can avoid injuries caused by climbing or reaching over other pallets of materials to get to a position where the document can be read. Injuries can further be avoided by avoiding unnecessary lifting of the materials for example where materials are lifted to a position for the work order to be read and then found to be material which is not required and thus needs to be replaced. Yet further, the ability of many persons to read declines with age so that while a younger person may be able to reach or read the materials without difficulty, an older person may have increased difficulty due to the necessity to change focus and due to a general decline in eye sight.

5. The system allows the foreman to quickly assess the amount of work of a particular type on the floor. If therefore there appears by studying the coloured labels to be too many orders for a particular operation, for example too many brown labels that is the break operation, the foreman can implement an increased work level for that operation by increasing shift length or the like. 6. Each operator can, if the reach the position of having no apparent work for that operation, can quickly scan the materials on the work shop floor to locate any additional work available for that operation with the possibility of rescheduling to progress another order through a previous operation to generate work for the operation which is running short.

7. Illiteracy is a significant concern in modern society and can lead to many mistakes and loss of production time. The colour coding system of the present invention reduces the difficulty of the illiterate person so that they can be more effective despite the difficulty or inability to read the instructions. It is well known that persons having difficulty with literacy often try to hide this difficulty and accordingly the colour coding system can help them overcome the difficulty and allow them to operate effectively using the colour coding system and the drawings.

8. Due to an improved management or supervision system, costs can be reduced by ensuring that particularly required functions are carried out during normal working hours without the necessity to undertake overtime which involves high costs of hourly rates and without the necessity of farming out various parts with the significantly increased cost that this involves.

9. The use of colours in the workplace will give the workers a psychological boost which will reduce frustrations and improve the attitude of the operators. The reduction of the aggravations and frustrations involved in the above also will improve the operator attitude. This will enable increased production of better quality product.

The system of the present invention therefore provides a significant increase of efficiency by reducing inspection time and thus increasing the proportion of time used in actually operating upon the materials to be machined.

The costs of implementation of the present system is relatively low in view of the simple elements that are required. The learning time is very low in view of the simple association set forth above of the various colours with the associated jobs. Preferably therefore the system would be set up as a universal standard so that employees moving from one machine shop to another would have no difficulty caused by varying standards at different locations.

Since various modifications can be made in my invention as hereinabove described, and many apparently widely different embodiment of same made within the spirit and scope of the claims without departing from such spirit and scope, it is intended that all matter contained in the accompanying specification shall be interpreted as illustrative only and not in a limiting sense.

I claim:

1. A method of managing work progress of separate work jobs in a machine shop having a plurality of separate machining functions, the method comprising providing a plurality of coloured labels, each separate machining function having associated therewith a specific individual colour of the labels visually distinct from the colours of the labels of the other separate machining functions, forming for each separate job an order document having written instructions thereon for the separate machining functions required for that separate job, applying to the separate job a plurality of said plurality of coloured labels so as to be carried thereby and to be visually apparent thereon, labels applied to the separate job being selected from said plurality of coloured labels such that the labels are applied to the separate job in an order corresponding to the separate machining functions required for that separate job, selecting for each separate machining function a separation job from the plurality of jobs to be effected by visual inspection of the coloured labels, effecting each required machining function in turn to the separate job and, after completion of each machining function, removing the coloured label associated with that machining function from the order of the labels.

2. The method according to claim 1 wherein the labels are applied to the order document in an aligned column.

3. The method according to claim 1 wherein the colours are selected such that each colour is associated with the respective machining functions such that the name of the colour is associated with the name of the machining function by alliteration.

4. The method according to claim 1 wherein the order document comprises an instruction sheet and a drawing both of which are inserted into a transparent cover and wherein the labels are applied to the cover.

5. The method according to claim 1 including applying a further label of a dimension which is visually distinct from said plurality of coloured labels for indicating a destination of the work job at the completion of each machining function.

6. The method according to claim 3 wherein the colours are selected such that the colour grey is associated with the machining function of grinding, the colour brown is associated with the machining function of a break, the colour peach is associated with the function of a punch and the colour tan is associated with the function of a tapping.

7. The method according to claim 3 wherein the colour red is associated with the function of a roll, the colour rose is associated with the function of a router, the colour lime is associated with the function of a lathe, the colour taupe is associated with a function of threading, the colour blue is associated with a function of bending, the colour pink is associated with the function of painting, the colour black is associated with a function of beading, the colour mauve is associated with a function of milling, the colour purple is associated with a plasma machine, the colour navy is associated with a N.C. machine, the colour silver is associated with the function of shearing.

8. The method according to claim 3 wherein the colour copper is associated with a function of cutting copper tubing, the colour woodgrain is associated with a function of a woodshop, the colour orange is associated with a function of drilling, the colour caramel is associated with a function of counter sink drilling, the colour yellow is associated with a function of a laser, the colour green is associated with a function of a saw.

9. The method according claim 1 wherein the labels include a white label for receiving annotations written thereon.

10. A method of managing work progress of separate work jobs in a machine shop having a plurality of separate machining functions, the method comprising providing a plurality of coloured identifying elements associating each separate machining function therewith a specific individual colour of the elements visually distinct from the colours of the elements of the other separate machining functions, forming for each separate job an order document having written instructions thereon for the separate machining functions required for that separate job, applying to the separate job at least one of said coloured elements so as to be carried thereby and to be visually apparent thereon, said at least one element applied to the separate job being selected from said plurality of colours such that said at least one element is applied to the separate job corresponding to the separate machining function required for that separate job, selecting for each separate machining function a separate job from the plurality of jobs to be effected by visual inspection of the coloured element, effecting the required machining function to the separate job and, after completion of the machining function, removing from the job the coloured element associated with that machining function.

11. The method according to claim 10 wherein a further coloured element is applied to the job after completion of that machinery function, the further element being associated with the next required machinery function.

12. The method according to claim 10 wherein each coloured element comprises a loose coloured sheet element loosely placeable on a container for parts forming said work job.

* * * * *